US011602753B2

(12) United States Patent
Koshinsky et al.

(10) Patent No.: US 11,602,753 B2
(45) Date of Patent: Mar. 14, 2023

(54) LABORATORY DEVICE

(71) Applicant: LevGo, Inc., Berkeley, CA (US)

(72) Inventors: Heather Koshinsky, El Cerrito, CA (US); Margret Leventhal, Berkeley, CA (US); Kent McCue, El Cerrito, CA (US)

(73) Assignee: LEVGO, INC., Berkeley, CA (US)

( * ) Notice: Subject to any disclaimer, the term of this patent is extended or adjusted under 35 U.S.C. 154(b) by 96 days.

(21) Appl. No.: 16/786,354

(22) Filed: Feb. 10, 2020

(65) Prior Publication Data

US 2021/0245163 A1 Aug. 12, 2021

(51) Int. Cl.
*B01L 9/06* (2006.01)
*B01L 9/00* (2006.01)

(52) U.S. Cl.
CPC ..... *B01L 9/00* (2013.01); *B01L 2300/123* (2013.01)

(58) Field of Classification Search
CPC ..... B01L 9/06; B01L 9/52; B01L 9/54; B01L 9/543; B01L 9/547
See application file for complete search history.

(56) References Cited

U.S. PATENT DOCUMENTS 3,085,776 A * 4/1963 Mycock ..... B01L 9/06 248/153
3,199,684 A * 8/1965 Bradley ..... B01L 9/06 211/130.1

* cited by examiner

*Primary Examiner* — Paul S Hyun
(74) *Attorney, Agent, or Firm* — BakerHostetler

(57) ABSTRACT

A device for supporting a laboratory object is provided. The device may comprise a body extending about and defining an opening. The body may be positioned in a customized orientation selected from a plurality of orientations. The device may include a first support defined by the body and configured to contact a surface when the body is in a first orientation. The device may include a second support coupled to the first support. The second support may be configured to contact the surface when the body is in a second orientation.

17 Claims, 15 Drawing Sheets

LABORATORY DEVICE

FIELD OF THE INVENTION

The following description relates to laboratory devices, and more specifically, to a laboratory device configured to be positioned in a plurality of orientations and operable to support at least one item.

BACKGROUND

In education, science, art, engineering, and medical fields, various users (i.e., scientists, researchers, technicians, doctors, other care providers, engineers, artists, teachers, assistants, students, observers, etc.) employ a wide variety of items while conducting varied tasks such as, but not limited to, sample acquisition, sample examination, sample measurement, or sample transfer. For example, a sample (or portion of a sample) is often weighed, measured, visually inspected, counted, transferred from one container to another, divided between containers or a portion transferred/moved to a new container, or returned to the original container. In other examples, laboratory tools, art tools or other types of tools in various settings (e.g., gardening, industrial, painting, sculpture, crafting, construction, food preparation and consumption, etc.), may be used for multiple applications.

Conventional tools to observe a sample typically include multiple tools to hold, measure, and/or observe the sample. Such tools may also prevent the sample and/or other tools from contacting a surface, such as a table surface or a bench surface. Conventional tools may also prevent objects or tools used in other applications (e.g., gardening, industrial, painting, sculpture, crafting, construction, etc.) from contacting the surface or may hold another tool or object in a location. Such conventional tools may be flimsy in nature and may lead to a loss of a sample and/or difficulty in obtaining and handling the sample, tool or object. Other tools may be too rigid, heavy, and/or difficult to maneuver. Further, tools used in other applications may be damaged or misplaced during use.

Accordingly, there exists a need for a device that does not suffer from the aforementioned deficiencies, that is operable to support or hold at least one item, such as a sample or a tool, and is easy to use, lightweight, malleable, and supportive.

SUMMARY

Implementations described and claimed herein address the foregoing problems by providing a laboratory device positionable in multiple orientations to support or hold at least one item.

Disclosed herein is a laboratory device. The device may include a body extending about and defining an opening. The device may include a first support defined by the body. The first support may be configured to contact a surface when the device is in a first orientation. The first support may include at least one trough. The at least one trough may contact the surface when the device is in the first orientation. The device may include a second support defined by the body. The second support may be coupled to the first support. The second support may be configured to contact the surface when the device is in a second orientation. The second orientation may be inverted from the first orientation. The device may include at least one wing forming the second support. The at least one wing may have a support surface contacting the surface when the device is in the second orientation. At least one of the first support or the second support may be malleable.

Also disclosed herein is another laboratory device. The device may include a body extending about and defining an opening. The device may include a first support defined by the body. The first support may define a first plane configured to contact a surface in a first orientation of a plurality of orientations. The device may include a first trough opposing a second trough. Each of the first trough and the second trough may be disposed on the first plane. The device may include at least one crest disposed adjacent to at least one trough. The device may include a second support defined by the body. The second support may be coupled to the first support. The second support may define a second plane configured to contact the surface in a second orientation of the plurality of orientations. The device may include a first wing opposing a second wing. The device may include a first support surface of the second support defined by the first wing. The device may include a second support surface of the second support defined by the second wing. The first support surface and the second support surface may each be disposed on the second plane. At least one of the first support or the second support may be malleable.

Also disclosed herein is yet another laboratory device. The device may include a body extending about and defining an opening. At least a portion of the body may be malleable into a customized position selected from a plurality of positions. The device may include a cradle defined by the body. The cradle may be configured to receive and hold at least one item with the body arranged in the customized position and a customized orientation selected from a plurality of orientations. The device may include a first support defined by the body. The first support may have a first plane. The first plane may contact a surface when the body is in a first orientation. The device may include a second support coupled to the first support. The second support may have a second plane contacting the surface when the body is in a second orientation. The second orientation may be inverted from the first orientation.

BRIEF DESCRIPTION OF THE DRAWINGS

FIG. 10 illustrates a side view of the first embodiment with a rounded edge;

DETAILED DESCRIPTION

Figure 1A:
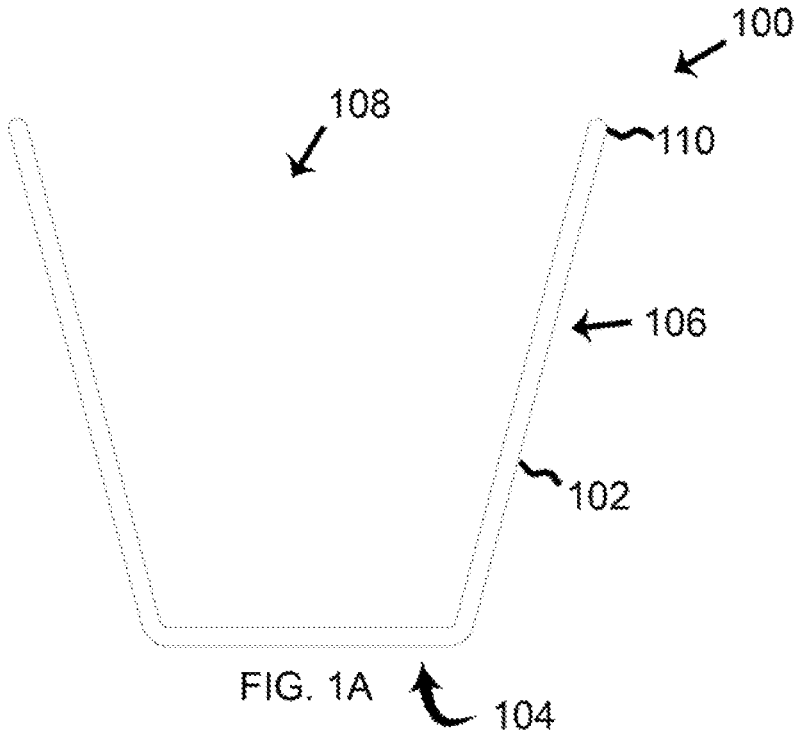
FIG. 1A illustrates a side view of a first non-limiting embodiment of a laboratory device.

It is to be understood that the present disclosure is not limited in its application to the details of construction and to the embodiments of the components set forth in the following description or illustrated in the drawings. The figures and written description are provided to teach any person skilled in the art to make and use the presently disclosed technology. The presently disclosed technology is capable of other embodiments and of being practiced and carried out in various ways. Persons of skill in the art will appreciate that the development of an actual commercial embodiment incorporating aspects of the presently disclosed technology will require numerous implementations—specific decisions to achieve the developer's ultimate goal for the commercial embodiment. While these efforts may be complex and time-consuming, these efforts, nevertheless, would be a routine undertaking for those of skill in the art having the benefit of this disclosure.

Further, as the presently disclosed technology is susceptible to embodiments of many different forms, it is intended that the present disclosure be considered as an example of the principles of the presently disclosed technology and not intended to limit the presently disclosed technology to the specific embodiments shown and described. Any one of the features of the presently disclosed technology may be used separately or in combination with any other feature. References to the terms "embodiment," "embodiments," and/or the like in the description mean that the feature and/or features being referred to are included in, at least, one aspect of the description. Separate references to the terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments, but is not necessarily included. Thus, the presently disclosed technology may include a variety of combinations and/or integrations of the embodiments described herein. Additionally, all aspects of the present disclosure, as described herein, are not essential for its practice. Likewise, other systems, methods, features, and advantages of the presently disclosed technology will be, or become, apparent to one with skill in the art upon examination of the figures and the description. It is intended that all such additional systems, methods, features, and advantages be included within this description, be within the scope of the present inventive concept, and be encompassed by the claims.

Turning to FIG. 1A, a side view of a first non-limiting embodiment of a laboratory device 100 is illustrated. The device 100 may be manufactured from a solid or rigid material (i.e., metal, plastic, rubber, etc.), from a malleable or resilient material (i.e., thin metal, wire, etc.), or a combination of materials. The device 100 includes a body 102 having a first support 104 and a second support 106 defining a cradle 108. The second support 106 extends to an edge 110.

Figure 1B:
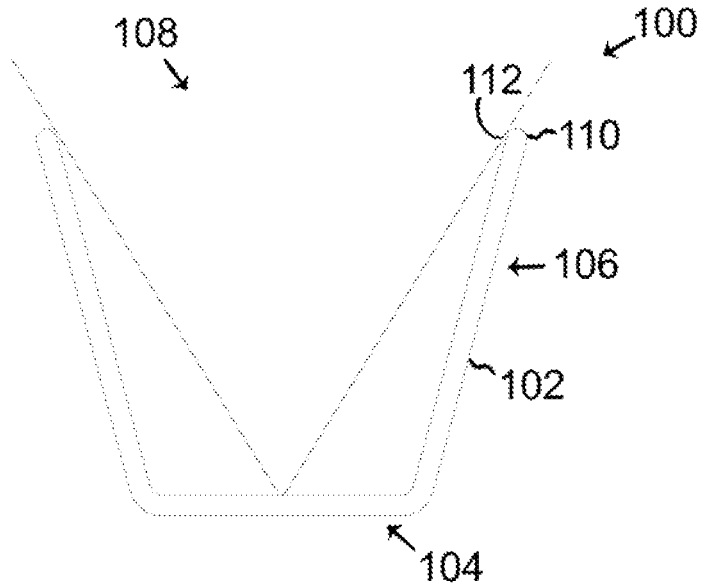
FIG. 1B illustrates another side view of the first embodiment of the laboratory device supporting an item.
Figure 1C:
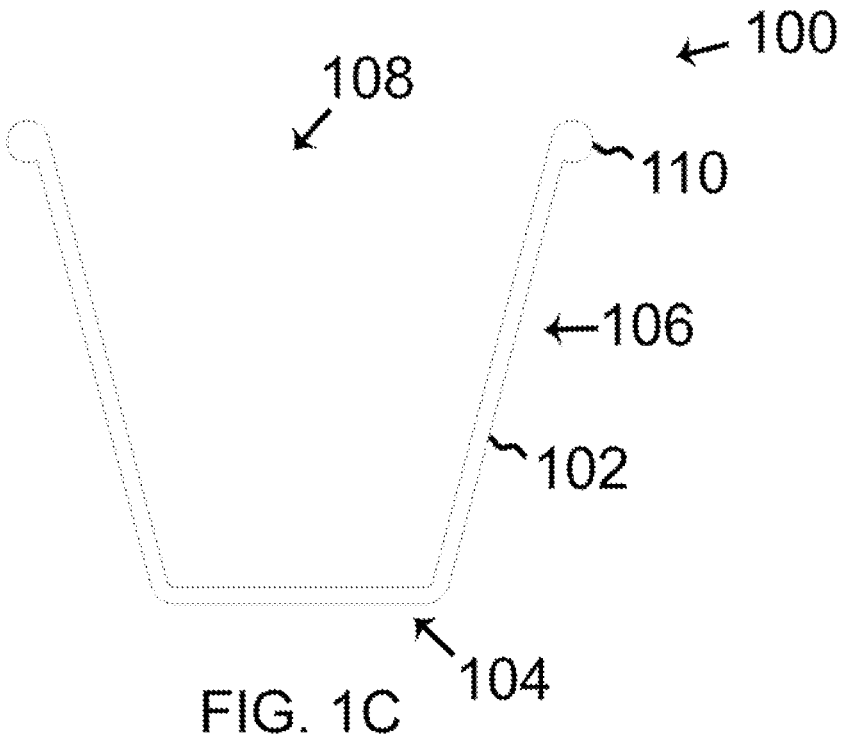
FIG. 1D illustrates a side view of the first embodiment with a center indent.
FIG. 1E illustrates a side view of the first embodiment with a first v-support.
FIG. 1F illustrates a side view of the first embodiment with a second v-support.
FIG. 1G illustrates a side view of the first embodiment having a third v-support.

As shown in FIG. 1B, which illustrates another side view of the device 100 supporting an item 112, the cradle 108 may be operable to hold or support the item 112. The item 112 may be for example, but not limited to, a laboratory item, a sample, a weighing paper, a test tube, a beaker, a garden item, a manufacturing item, or the like.

FIG. 10 illustrates a side view of the device 100. As shown, the second support 106 extends to the edge 110, which is rounded, though the edge 110 may be any shape. The edge 110 may be textured and provide additional frictional support to the item 112 (as shown in FIG. 1B) or may provide additional grip or support to a user picking up the device 100.

The first support 104 may include various surfaces and/or structures to stabilize, support, hold, or center a base of the item 112. In some examples, as shown in FIGS. 1D-1G, the first support 104 may include a stabilizer 114 that may extend along or partially along a centerline of the first support 104. In other examples, the stabilizer 114 may be angled on the first support 104, may extend on a portion of the first support 104, or otherwise be oriented in any angle or position on the first support 104.

Figure 1D:
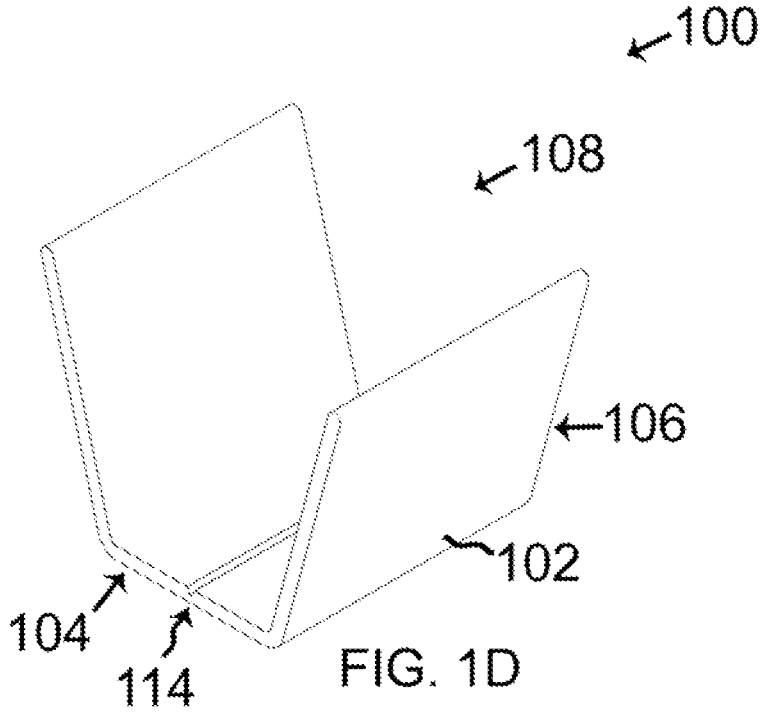

For example, FIG. 1D illustrates a side view of the device 100 where the stabilizer 114 is a center indent that may capture an edge of an item 112 (as shown in FIG. 1B) to support and center the item 112.

Figure 1G:
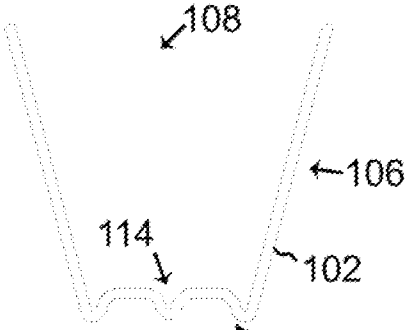
Figure 1E:
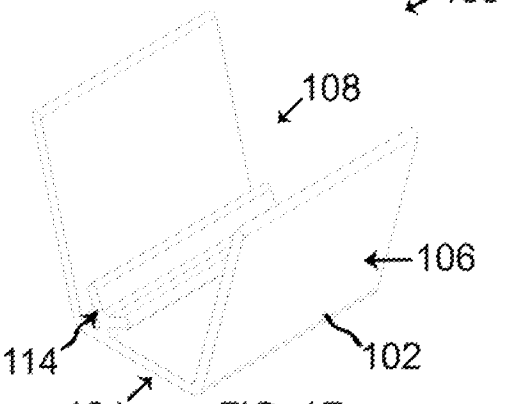

FIG. 1E illustrates a side view of the device 100 where the stabilizer 114 is a first v-support positioned on the first support 104 and off a center line of the first support 104.

Figure 1F:
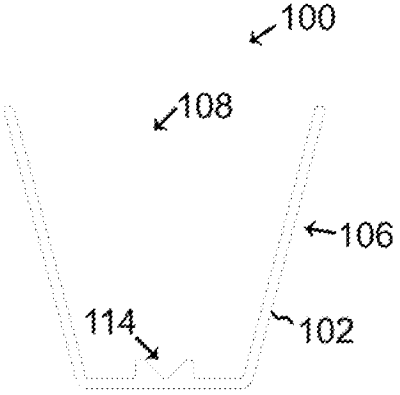

FIG. 1F illustrates a side view of the device 100 where the stabilizer 114 is a second v-support positioned on the first support 104 and on a center line of the first support 104.

FIG. 1G illustrates a side view of the device 100 where the stabilizer 114 is a third v-support positioned on the first support 104.

Each of the first, second, and third v-supports described above may open at varying angles, may be positioned off of the centerline of the first support 104, may be positioned on the centerline of the first support 104, and/or may have varying thicknesses.

Figure 2A:
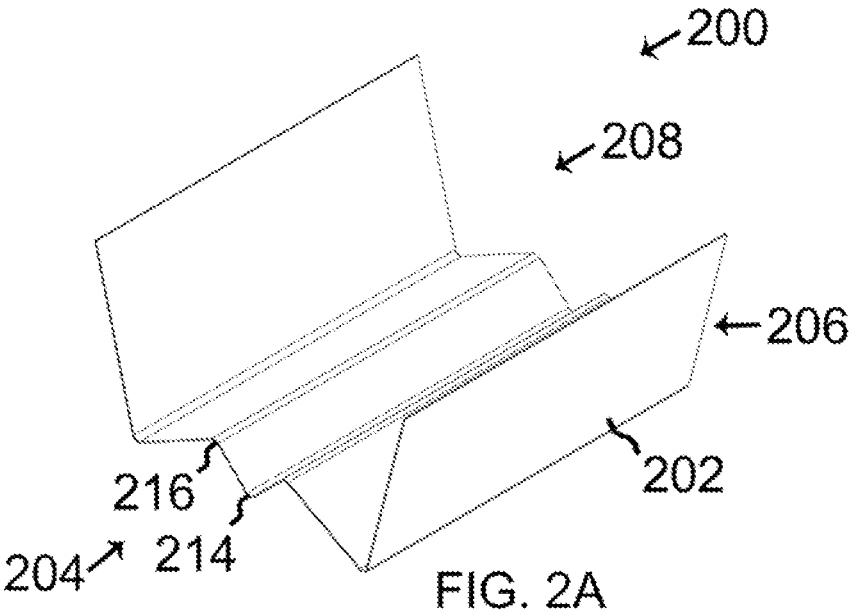
FIG. 2A illustrates an isometric view of a second non-limiting embodiment of the laboratory device.

Turning to FIG. 2A, an isometric view of a second non-limiting embodiment of the laboratory device 200 is illustrated. The device 200 may be manufactured from a solid or rigid material (i.e., metal, plastic, rubber, etc.), from a malleable or resilient material (i.e., silicone, thin metal, wire, etc.), or a combination of materials. The device 200 includes a body 202 having a first support 204 and a second support 206, and a cradle 208 defined by the first support 204 and the second support 206. The cradle 208 may support an item 212 (visible in FIGS. 2C and 2D). The first support 204 may include at least one trough 214 and at least one crest 216 adjacent to the at least one trough 214. The at least one trough 214 is operable to support the item 212 and can stabilize and/or center the item 212. The at least one trough 214 can further enable the device 200 to compress or expand in length when at least a first support 204 is manufactured from a malleable material. Such adjustment in length is advantageous to accommodate items 212 of various sizes. The first support 204 is coupled to the second support 206, which may extend to at least one wing as described below.

Figure 2B:
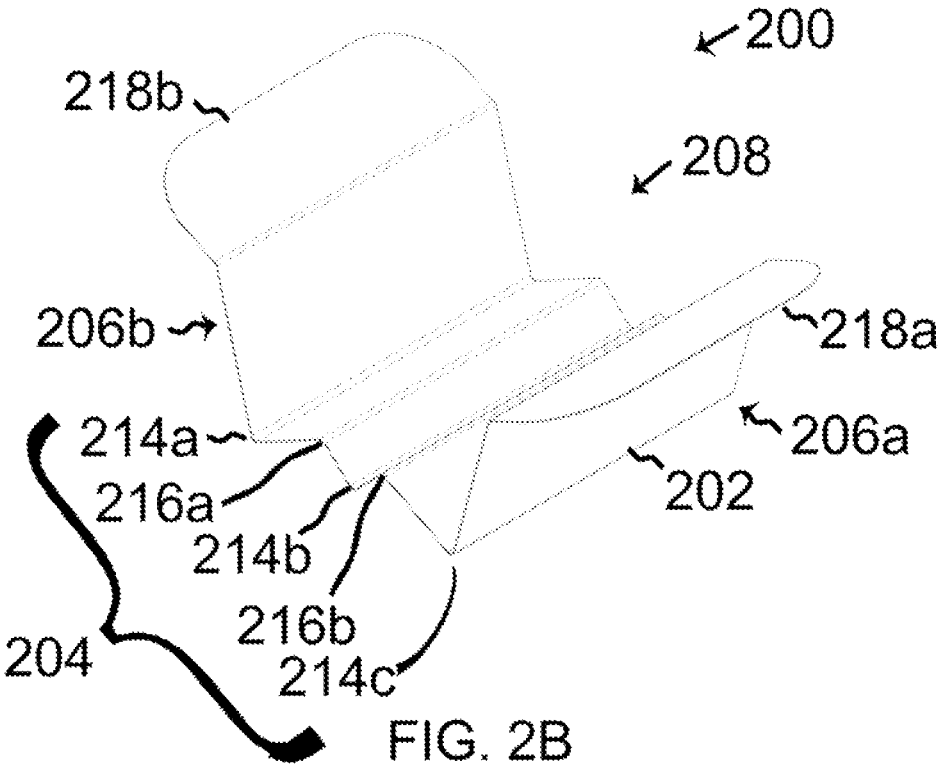
FIG. 2B illustrates an isometric view of the second embodiment with a pair of wings.
Figure 2C:
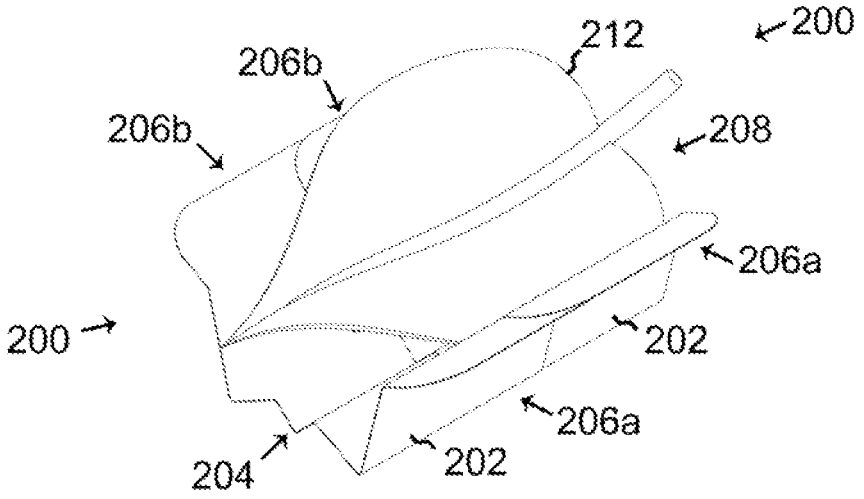
FIG. 2C illustrates an isometric view of a pair of the second embodiment devices each having a pair of wings and supporting an item.
Figure 2D:
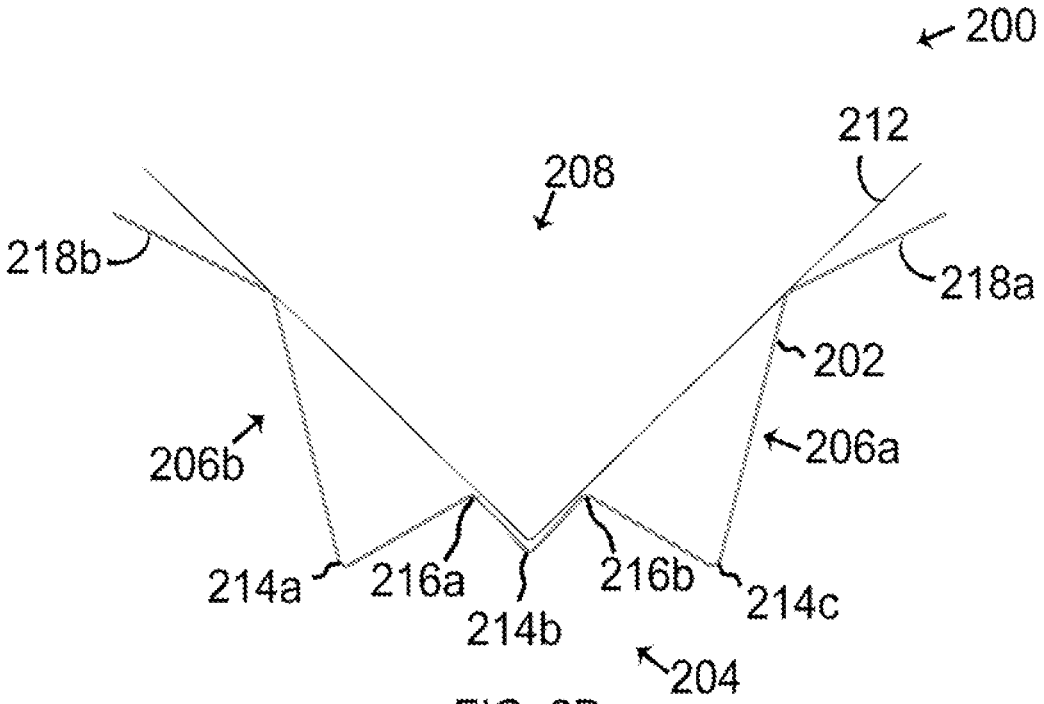
FIG. 2D illustrates a front view of the second embodiment having a pair of wings and supporting an item.

FIG. 2B illustrates an isometric view of the device 200 with a pair of wings 218*a*, 218*b* extending from a pair of second supports 206*a*, 206*b*. Each wing 218*a*, 218*b* is disposed on opposite ends of the first support 204. Each wing 218*a*, 218*b* may be pinched or gripped by a user to adjust the device 200 by pulling each wing 218*a*, 218*b* apart from each other or by pushing each wing 218*a*, 218*b* towards each other when at least each wing 218*a*, 218*b* is made from a malleable material. Further, a corner of each wing 218*a*, 218*b*, or any portion of each wing 218*a*, 218*b*, may be pushed or pinched together. Similarly, any portion of each second support 206*a*, 206*b* may be pushed together or pulled apart. In other examples, the second supports 206*a*, 206*b* may include none, one, two, or more than two wings. The wings 218*a*, 218*b* may also be operable to provide further support to the item 212 (as shown in FIGS. 2C and 2D). The wings 218*a*, 218*b* may have rounded edges, though the wings 218*a*, 218*b* can have sharp, angled, wavy, or any shaped edges.

Further shown in FIG. 2B, the first support 204 includes three troughs 214*a*, 214*b*, 214*c* and two crests 216*a*, 216*b*, though in other embodiments the first support 204 may include one, two, or more than two troughs and/or zero, one, two, or more than two crests.

FIG. 2C illustrates an isometric view of a pair of the devices 200, supporting the item 212 (e.g., a leaf). The cradle 208 of each of the pair of devices 200 may together support the item 212. As shown, more than one device 200 may be used together to support items of various sizes.

FIG. 2D illustrates a front view of the device 200 supporting the item 212 (e.g., a creased paper). The item 212 may be supported by each of the second supports 206*a*, 206*b* and also supported and centered by trough 214*b*, though any trough (e.g., 214*a* or 214*c*) may be used to center, stabilize, and/or support the base of the item 212.

Figure 3A:
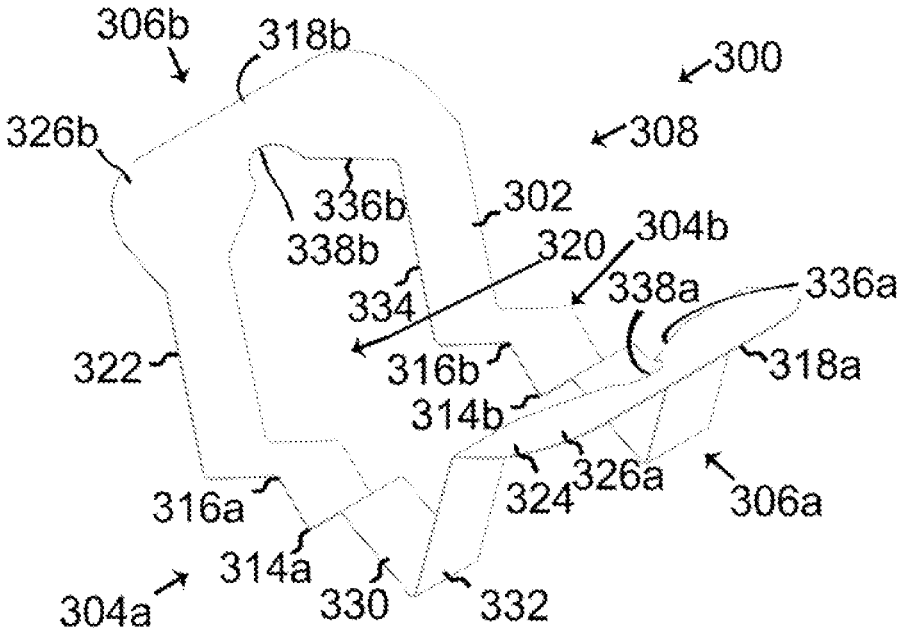
FIG. 3A illustrates an isometric view of a third non-limiting embodiment of the laboratory device in a first orientation.

FIG. 3A illustrates an isometric view of a third non-limiting embodiment of the laboratory device 300 in a first orientation. The device 300 is operable to be positioned or formed into a plurality of orientations. The device 300 may be manufactured from a solid or rigid material (i.e., metal, plastic, rubber, etc.), a malleable or resilient material (i.e., silicone, thin metal, wire, etc.), or a combination of materials. In some instances, at least a portion of the device is manufactured from a rigid material, such as plastic, and a remaining portion of the device is manufactured from a malleable or resilient material, such as aluminum or silicone. In some instances, a portion of the device is manufactured from a rigid material that is greater than a portion of the device manufactured from a malleable or resilient material. In some instances, a portion of the device is manufactured from a rigid material that is less than a portion of the device manufactured from a malleable or resilient material. The material may be moldable, stretchable, and/or bendable into a static form. The material may also be stamped. The material may be further manipulated into further positions after it is first formed. The material may have a stiffness such that the device 300 can hold a shape and support an item 312, visible in FIGS. 3B, 3D, and 3F-3M.

In some variations, the material of the device may resist deformation elastically when stress is applied. In some instances, the material of the device may have a modulus of elasticity between 50 and 100 Giga Pascals (GPa). In some instances, the material of the device may be equal to or greater than 50 GPa. In some instances, the material of the device may be equal to or greater than 60 GPa. In some instances, the material of the device may be equal to or greater than 70 GPa. In some instances, the material of the device may be equal to or greater than 80 GPa. In some instances, the material of the device may be equal to or greater than 90 GPa. In some instances, the material of the device may be equal to or less than 100 GPa. In some instances, the material of the device may be equal to or less than 90 GPa. In some instances, the material of the device may be equal to or less than 80 GPa. In some instances, the material of the device may be equal to or less than 70 GPa. In some instances, the material of the device may be equal to or less than 60 GPa. In some instances, the material of the device may have a modulus of elasticity between 0.01 and 5 GPa. In some instances, the material of the device may be equal to or greater than 0.01 GPa. In some instances, the material of the device may be equal to or greater than 5 GPa.

In some instances, the material of the device may have a specific modulus between 20 and 30 E/ρ. In some instances, the material of the device may be equal to or greater than 20 E/ρ. In some instances, the material of the device may be equal to or greater than 30 E/ρ. In some instances, the material of the device may have a specific modulus between 0.01 and 2 E/ρ. In some instances, the material of the device may be equal to or greater than 0.01 E/ρ. In some instances, the material of the device may be equal to or greater than 2 E/ρ.

In some variations, the device may have a mean thickness equal to or greater than 0.001". In some variations, the device may have a mean thickness equal to or greater than 0.002". In some variations, the device may have a mean thickness equal to or greater than 0.003". In some variations, the device may have a mean thickness equal to or greater than 0.004". In some variations, the device may have a mean thickness equal to or greater than 0.005". In some variations, the device may have a mean thickness equal to or greater than 0.006". In some variations, the device may have a mean thickness equal to or greater than 0.007". In some variations, the device may have a mean thickness equal to or greater than 0.008". In some variations, the device may have a mean thickness equal to or greater than 0.009". In some variations, the device may have a mean thickness equal to or greater than 0.010". In some variations, the device may have a mean thickness equal to or greater than 0.011". In some variations, the device may have a mean thickness equal to or greater than 0.012". In some variations, the device may have a mean thickness equal to or greater than 0.013". In some variations, the device may have a mean thickness equal to or greater than 0.014". In some variations, the device may have a mean thickness equal to or greater than 0.015". In some variations, the device may have a mean thickness equal to or greater than 0.016". In some variations, the device may have a mean thickness equal to or greater than 0.017". In some variations, the device may have a mean thickness equal to or greater than 0.018". In some variations, the device may have a mean thickness equal to or greater than 0.019". In some variations, the device may have a mean thickness between 0.002" and 0.008". In some variations, the device may have a mean thickness between 0.01" and 0.1". In some variations, the device may have a mean thickness equal to or greater than 0.01". In some variations, the device may have a mean thickness equal to or greater than 0.1".

In some variations, the device may have a mean thickness equal to or less than 0.020". In some variations, the device may have a mean thickness equal to or less than 0.019". In some variations, the device may have a mean thickness equal to or less than 0.018". In some variations, the device may have a mean thickness equal to or less than 0.017". In some variations, the device may have a mean thickness equal to or less than 0.016". In some variations, the device may have a mean thickness equal to or less than 0.015". In some variations, the device may have a mean thickness equal to or less than 0.014". In some variations, the device may have a mean thickness equal to or less than 0.013". In some variations, the device may have a mean thickness equal to or less than 0.012". In some variations, the device may have a mean thickness equal to or less than 0.011". In some variations, the device may have a mean thickness equal to or less than 0.010". In some variations, the device may have a mean thickness equal to or less than 0.009". In some variations, the device may have a mean thickness equal to or less than 0.008". In some variations, the device may have a mean thickness equal to or less than 0.007. In some variations, the device may have a mean thickness equal to or less than 0.006". In some variations, the device may have a mean thickness equal to or less than 0.005".

The device 300 includes a body 302 extending about and defining an opening 320. The body 302 may include a gap or may be extend entirely around the opening 320. The body 302 may have an outer perimeter 322 that is rectangular shaped with rounded corners, though the outer perimeter 322 may have sharp corners and/or edges and may be any shape (i.e., square, polygon, polygon-like, starred, oval, circular, etc.).

The opening 320 may define an inner perimeter 334 that may be rectangular shaped, though in other examples the inner perimeter 334 may be any shape including, but not limited to, a square, polygon, polygon-like, oval, circle, ellipsoid, or the like. In other examples, the perimeter 334 may have a pair of elongated edges that are parallel to each other and extend to at least one transitional section. In the illustrated example, transitional sections 336*a*, 336*b* may each be angled, straight, or curved and may each further include a cut-out feature 338*a*, 338*b*, though the transitional sections 336*a*, 336*b* may include none, one, two, or more than two cut-features. The cut-out features 338*a*, 338*b* may be one or more semi-circular divots and may be any shape such as, but not limited to, a circular, oval, square, polygon, polygon-like, or rectangular, or triangular, or a slice. The transitional sections 336*a*, 336*b* and the cut-out features 338*a*, 338*b* may support and/or stabilize an item.

The body 302 may also define a cradle 308 operable to receive and hold at least one item when the body 300 is arranged in a first position or a customized position of a plurality of positions. The first position may be a position of the device 300 after the device has been manufactured (e.g., as sold). In other words, the device may start with a wide opening as originally formed but the user may squeeze the sides together or pull the sides apart to form a different position. The cradle 308 may be arranged in any number of positions when the device 300 is in any number of orientations. For example, the cradle 308 may be malleable from a first customized position to a second customized position, where the cradle 308 may be in a pinched position in the first customized position and the cradle 308 may be in an un-pinched position in the second customized position. In some examples, the device 300 may have a first distance between a pair of second supports when the cradle 308 is in the first customized position and a second distance between the pair of second supports when the cradle 308 is in the second customized position. The first distance may be different from the second distance in some examples.

The body 302 may also have a first surface 330 and a second surface 332. Each of the first surface 330 and the second surface 332 may contact a surface or an item at different orientations or different positions. For example, the first surface 330 may contact a surface when the device 300 is in one of a set of orientations or the second surface 332 may contact a surface when the device 300 is in another of the set of orientations.

The body 302 may have at least one first support and at least one second support. An angle between the at least one first support and the at least one second support may be between 25° and 160°. In the illustrated example, the body 302 includes opposing first supports 304*a*, 304*b* and opposing second supports 306*a*, 306*b*. The first supports 304*a*, 304*b* may be configured to contact a surface when the device 300 is in the first orientation of the plurality of orientations, as shown in FIG. 3A. The surface may be any surface such as, but not limited to, a surface of the ground (e.g., a ground surface, a floor surface, etc.), a surface of any object (i.e., a sample, a weighting paper, a beaker, a test tube, a pen, a balance, a piece of equipment, etc.), or a surface of any furniture (i.e., a table, a chair, a lab bench, a counter top, etc.) or material covering such surface.

Figure 3B:
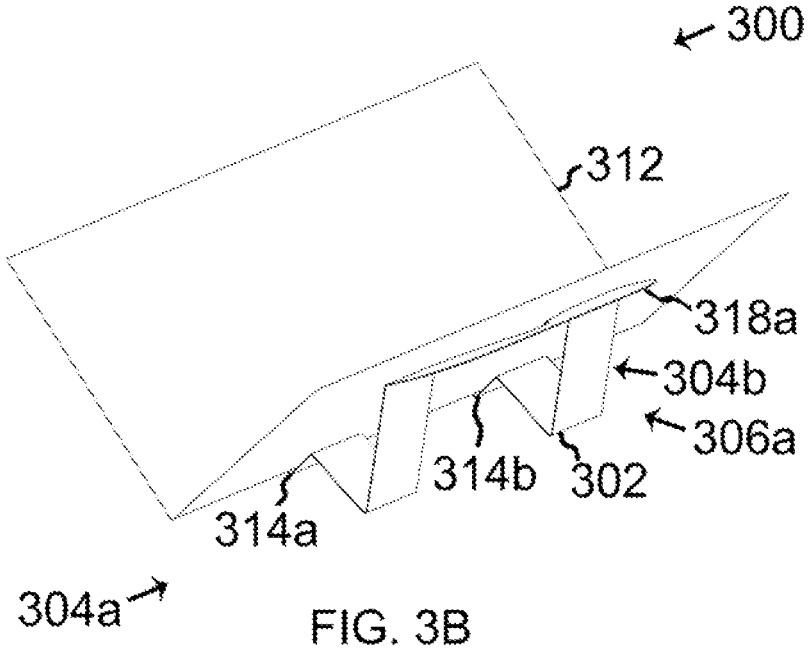
FIG. 3B illustrates another isometric view of the third embodiment in the first orientation and supporting an item.
Figure 3C:
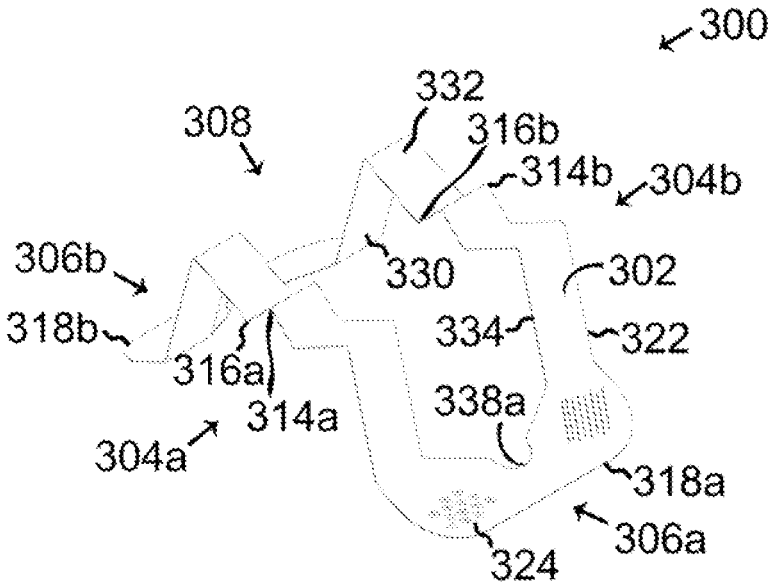
FIG. 3C illustrates an isometric view of the third embodiment in a second orientation.

FIG. 3B illustrates another isometric view of the device 300 in the first orientation and supporting item 312 (e.g., a creased paper). Each of the first supports 304*a*, 304*b* includes at least one trough 314*a*, 314*b*, respectively. Each of the at least one troughs 314*a*, 314*b* may have an open angle between 50° and 140°. As illustrated, each of the at least one troughs 314*a*, 314*b* may contact a surface when the device 300 is in the first orientation. Each of the first supports 304*a*, 304*b* may each further include at least one crest 316*a*, 316*b*, visible in FIG. 3A, adjacent to each of the at least one troughs 314*a*, 314*b*. The at least one trough 314*a*, 314*b* and the at least one crest 316*a*, 316*b* may enable the device 300 to compress or expand in length when the at least one trough 314*a*, 314*b* or the at least one crest 316*a*, 316*b* are formed from a malleable material. As shown, the device 300 may advantageously support, for example, a creased paper, which may hold a sample and may enable a user to move the device 300 without disturbing the sample FIG. 3C illustrates an isometric view of the device 300 in a second orientation. The second supports 306*a*, 306*b* may be configured to contact the surface when the device 300 is in a second orientation. The second orientation, for example, may be inverted from the first orientation. The second supports 306*a*, 306*b* may each include at least one wing. The at least one wing may have rounded, sharp, angled, or any shaped edges. In the illustrated example, each of the second supports 306*a*, 306*b* include a wing 318*a*, 318*b*, respectively. Similar to the second embodiment, each wing 318*a*, 318*b* may be pinched or gripped by a user at a grip portion 324 to adjust the device 300 by pulling each wing 318*a*, 318*b* apart from each other or by pushing each wing 318*a*, 318*b* towards each other. Further, any portion of each second support 306*a*, 306*b* may be pushed together or pulled apart. The grip portion 324 may be smooth, textured, ribbed, or the like to aid in gripping of the grip portion 324. Any portion of the device 300 may be smooth, textured, ribbed or the like to aid in gipping and applying a force to at least one of the wings 318*a*, 318*b*. Pulling each wing 318*a*, 318*b* apart from each other or pushing each wing 318*a*, 318*b* towards each other also, respectively, expands each trough 314*a*, 314*b*, and thus lengthens the device 300, or compresses each trough 314*a*, 314*b*, thus shortening the device 300. Similarly, each of the first supports 304*a*, 304*b* may be pulled apart from each other or pushed towards each other to, respectively, expand or compress a width of the device 300.

Figure 3D:
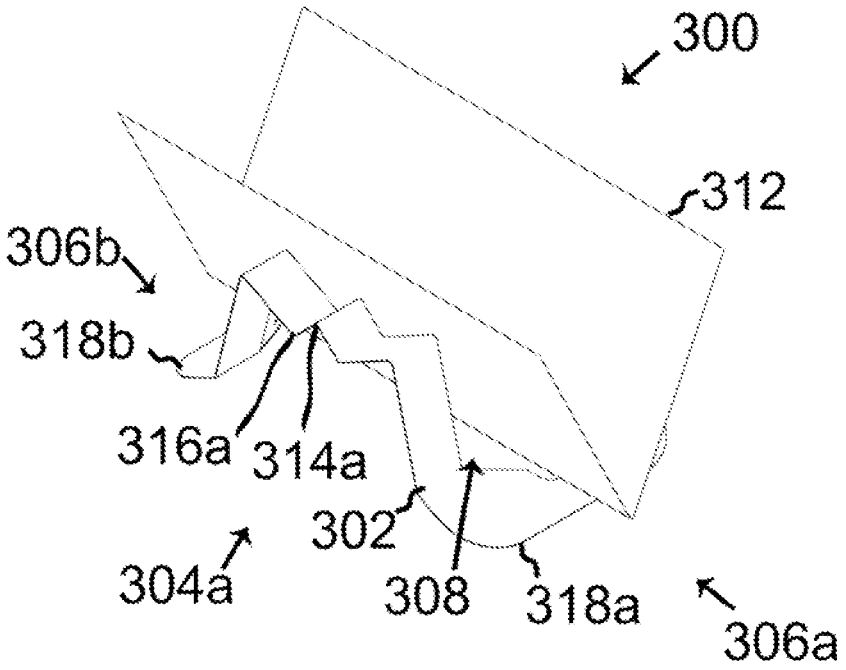
FIG. 3D illustrates another isometric view of the third embodiment in the second orientation and supporting an item.

FIG. 3D illustrates another isometric view of the device 300 in the second orientation and supporting item 312 (e.g., a creased paper). The wings 318*a*, 318*b* may contact the surface when the device 300 is in the second orientation and each of the wings 318*a*, 318*b* may include support surfaces 326*a*, 326*b* (visible in FIG. 3A), respectively. Each of the support surfaces 326*a*, 326*b* may be disposed on a second plane configured to contact the surface when the device 300 is in the second orientation.

It is foreseen that in other examples not illustrated, at least one first support may not have any crests and may be flat, undulating, wavy, or any other shape or pattern. It is also foreseen that each of the at least one first support may also include a wing. It is further foreseen that at least one second support may not include a wing and may include at least one trough and/or at least one crest.

Figure 3E:
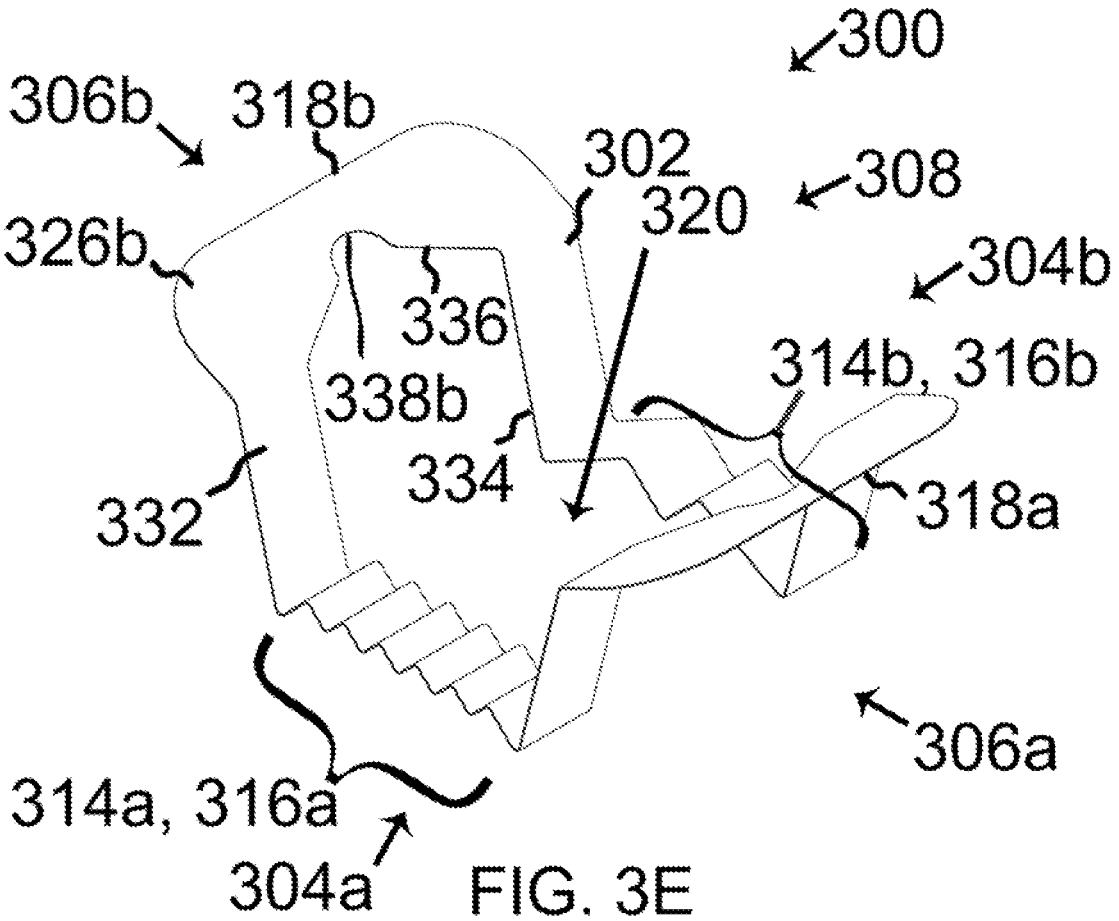
FIG. 3E illustrates an isometric view of an alternative version of the third embodiment.

FIG. 3E illustrates an isometric view of an alternative version of the device 300. The device 300 may include a first plurality of troughs 314*a* and crests 316*a* and a second plurality of troughs 314*b* and crests 316*b* opposing each other. The first plurality of troughs 314*a* and crests 316*a* may include more troughs than the second plurality of troughs 314*b* and crests 316*b*.

Various features of the device 300 are shown in FIGS. 3F-3M. The device 300 is shown in multiple orientations and illustrates the device's 300 ability to support items of various sizes and shapes. It will be appreciated that the device 300 is not limited to the illustrated examples and the device 300 may be formed into any shape and positioned into any orientation.

Figure 3H:
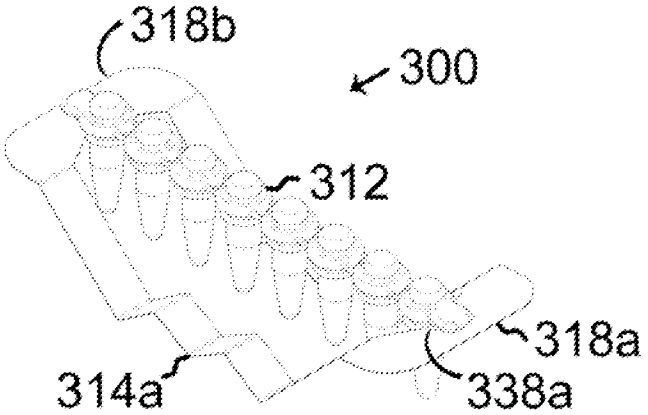
FIG. 3H illustrates another tilted top view of the third embodiment supporting an item in the first orientation.
Figure 3I:
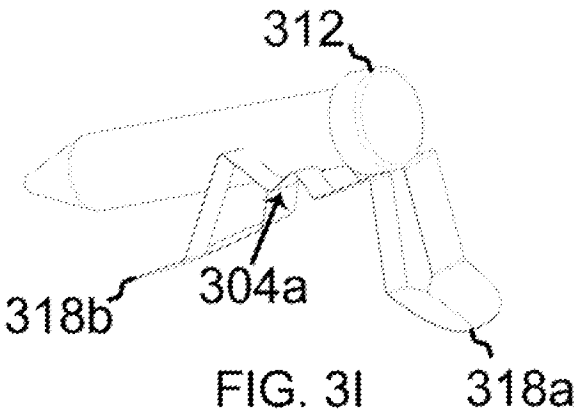
FIG. 3I illustrates a tilted side view of the third embodiment supporting an item in the second orientation.
Figure 3F:
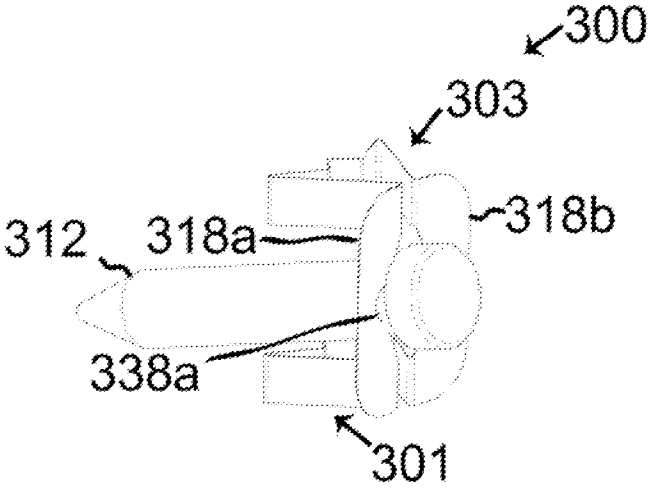
FIG. 3F illustrates a tilted side view of the third embodiment supporting an item in a third orientation.

FIG. 3F illustrates a tilted side view of the device 300 supporting item 312 (e.g., a test tube) in a third orientation. Each wing 318*a*, 318*b* are shown pushed together to hold item 312 in a side position. A first side 301 of the device 300 is configured to contact the surface when the device is in the third orientation, though the device 300 may be positioned on a second side 303 opposing the first side 301. The cut-out features 338*a*, 338*b* (not visible) may provide support to the item 312 and/or provide a recess that receives the item 312 so that each wing 318*a*, 318*b* can be pushed closer together or pulled further apart.

Figure 3G:
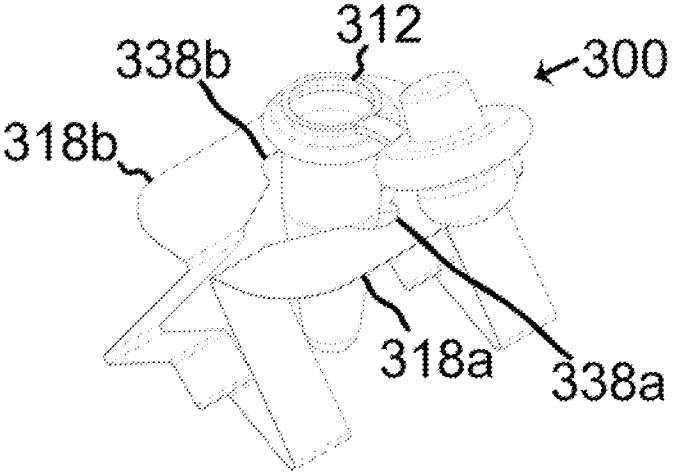
FIG. 3G illustrates a tilted top view of the third embodiment supporting an item in the first orientation.

FIG. 3G illustrates a tilted top view of the device 300 supporting item 312 (e.g., a microcentrifuge tube) in the first orientation. As similarly described above, each wing 318*a*, 318*b* is pushed together to hold item 312 in an upright position. The cut-out features 338*a*, 338*b* may provide support to the item 312 and/or provide a recess that receives the item 312 so that each wing 318*a*, 318*b* can be pushed closer together or pulled further apart.

FIG. 3H illustrates another tilted top view of the device 300 supporting an elongated item 312 (e.g., a strip of tubes) in the first orientation. Each wing 318*a*, 318*b* is pulled apart and supports item 312. The cut-out features 338*a*, 338*b* (not visible) may provide further support to and hold the item 312 in place in an upright position.

FIG. 3I illustrates a tilted side view of the device 300 supporting item 312 (e.g., a test tube) in the second orientation, where a portion of each wing 318*a*, 318*b* contacts a surface. The first supports 304*a*, 304*b* (not visible) are pushed towards each other to support the item 312 in a side position. As shown, the device 300 may beneficially prevent items, such as a test tube, from rolling on the surface by providing a stationary support for an item when the item is leaned over.

Figure 3K:
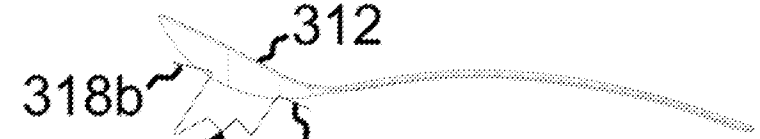
FIG. 3K illustrates a side view of the third embodiment supporting an item in the first orientation.
Figure 3M:
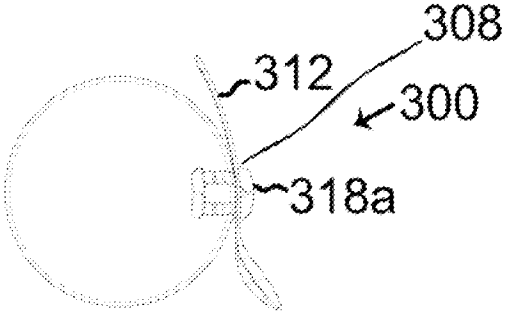
FIG. 3M illustrates a top view of the third embodiment supporting the item shown in FIG. 3L in the fourth orientation.
Figure 3J:
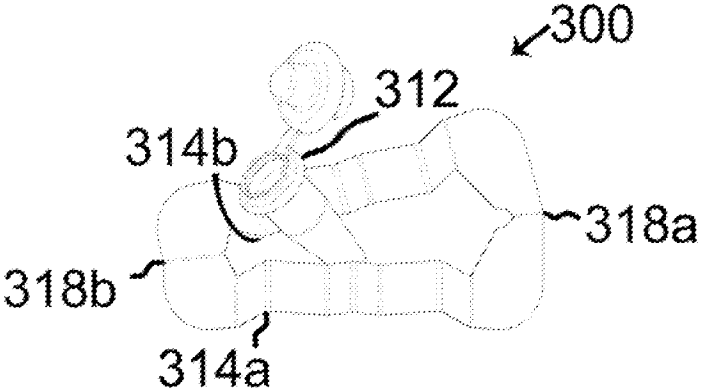
FIG. 3J illustrates a top view of the third embodiment supporting an item in the second orientation.

FIG. 3J illustrates a top view of the device 300 supporting item 312 (e.g., a microfuge tube) in the second orientation. One of the at least one troughs 314*a*, 314*b* that are positioned closest to the wing 318*b* are shown pushed together, or pinched together, such that a width of the wing 318*b* is less than a width of the wing 318*a*. Such positioning may hold an item in an upright position.

FIG. 3K illustrates a side view of the device 300 supporting item 312 (e.g., a spoon) in the first orientation. Wing 318*a* is pulled away from the first supports 304*a*, 304*b* (not visible), whereas wing 318*b* is pushed towards the first supports 304*a*, 304*b* (not visible). Such positioning may support, for example, a spoon as shown.

Figure 3L:
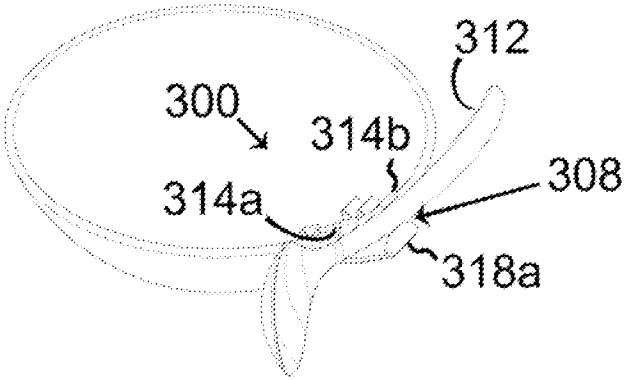
FIG. 3L illustrates a tilted top view of the third embodiment supporting an item in a fourth orientation.

FIG. 3L illustrates a tilted top view of the device 300 supporting item 312 (e.g., a spoon) in a fourth orientation. The device 300 is bent into the fourth orientation such that both of the at least one troughs 314*a*, 314*b* closest to wing 318*a* are compressed and bent over an edge of another item (e.g., a rim). The troughs 314*a*, 314*b* are configured to contact the edge such that the device 300 hangs over the edge. In other examples, the device 300 may hang over any rim, ridge, or edge of any item, such as a beaker, bowl, cup, or the like.

FIG. 3M illustrates a top view of the device 300 supporting item 312 shown in FIG. 3L in the fourth orientation. The cradle 308 is formed by wing 318*a* and is configured to support the item 312 when the device is in the fourth orientation. Such positioning may provide support to one or more items that are complimentary to another item (e.g., a test tube positioned on an edge of a beaker).

Figure 4A:
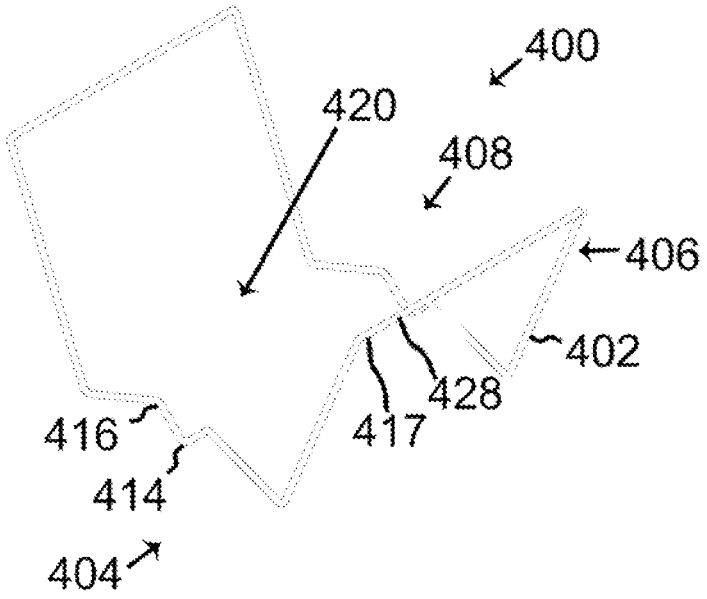
FIG. 4A illustrates an isometric view of a fourth non-limiting embodiment of the laboratory device in a first orientation.

FIG. 4A illustrates an isometric view of a fourth non-limiting embodiment of the laboratory device 400 in a first orientation. The device 400 may be manufactured from a solid or rigid material (i.e., metal, plastic, rubber, etc.), from a malleable or resilient material (i.e., silicone, thin metal, wire, etc.), or a combination of materials.

The device 400 includes a body 402 extending about and defining an opening 420. The body 402 may extend entirely around the opening 420. The body 402 may also define a cradle 408 operable to receive and hold at least one item when the body 400 is arranged in a first position or a customized position of a plurality of positions. The first position may be a position of the device 400 after manufacturing (e.g., as sold). The cradle 408 may be arranged in any number of positions when the device 400 in any number of orientations.

The body 402 defines a first support 404 and a second support 406. An angle between the second support 406 and the first support 404 may be between 25° and 160°. The first support 404 may be configured to contact a surface when the device 400 is in a first orientation of a plurality of orientations. At least one trough 414 may form the first support 404 and may contact the surface when the device 400 is in the first orientation. The at least one trough 414 may have an open angle between 50° and 140°. At least one crest 416 adjacent to the at least one trough 414 may also form the first support 404. The at least one trough 414 and the at least one crest 416 enables the first support 404 to compress or expand in length or change an angle with the second support 406, when at least the first support 404 is formed from a malleable material. The second support 406 may include a bar 417. The bar 417 may have a support surface 428 that contacts a surface when the device 400 is in the second orientation.

Figure 4B:
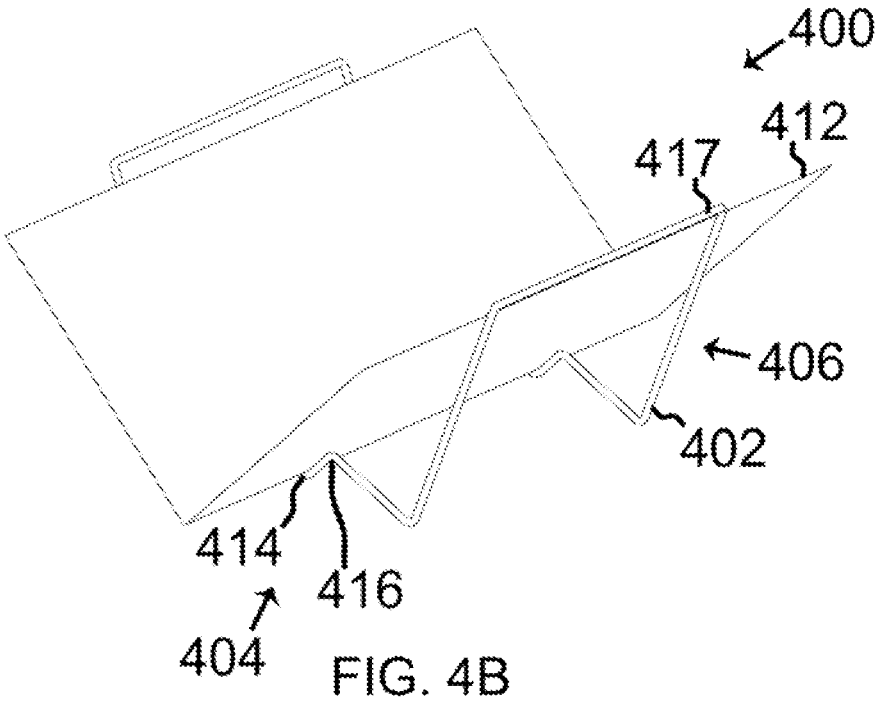
FIG. 4B illustrates an isometric view of the fourth embodiment in the first orientation and supporting an item.

FIG. 4B illustrates an isometric view of the device 400 in the first orientation supporting item 412 (e.g., a creased paper). As shown, the device 400 may advantageously support, for example, a creased paper which may hold a sample and enable a user to move the device 400 without disturbing the sample when the device is in the first orientation.

Figure 4C:
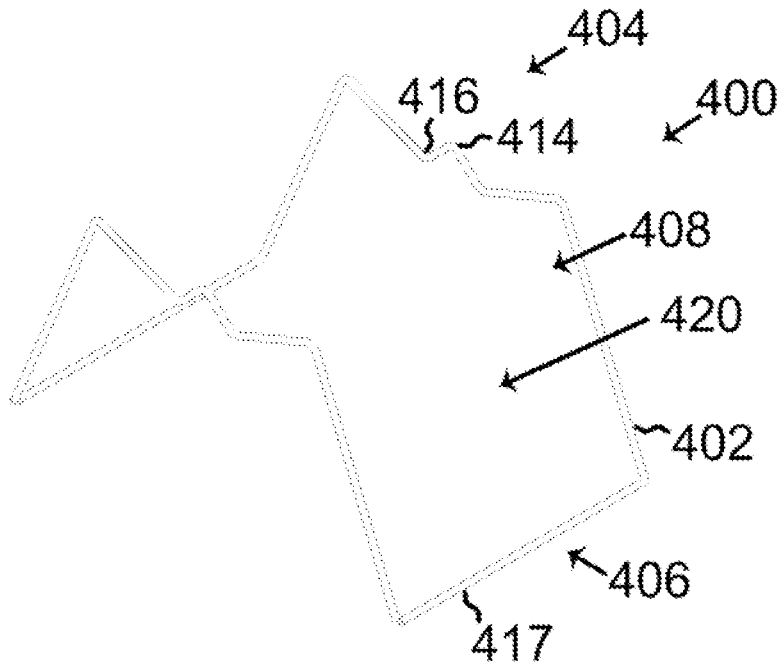
FIG. 4C illustrates an isometric view of the fourth embodiment in a second orientation.

FIG. 4C illustrates an isometric view of the device 400 in a second orientation. The second support 406 may be configured to contact a surface when the device 400 is in the second orientation. The second orientation, for example, may be inverted from the first orientation.

Figure 4D:
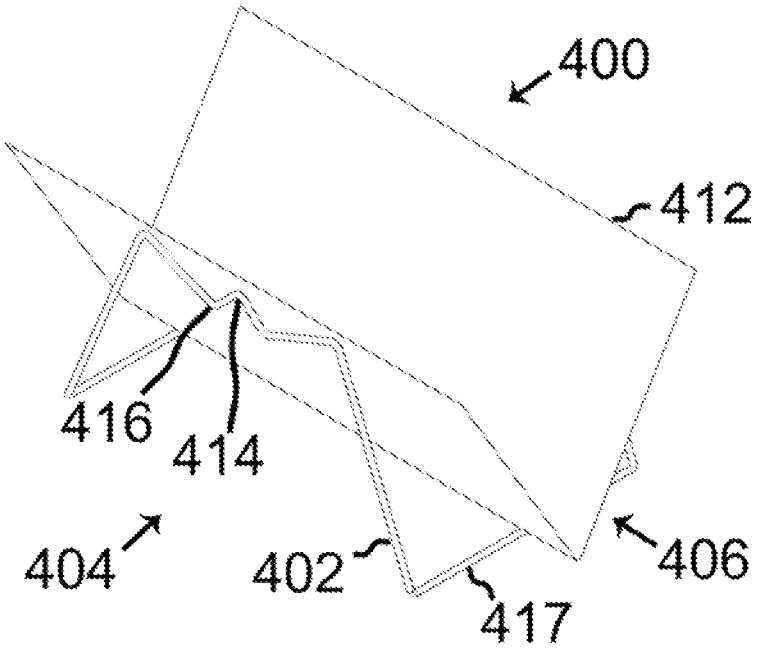
FIG. 4D illustrates an isometric view of the fourth embodiment in the second orientation and supporting an item.

FIG. 4D illustrates an isometric view of the device 400 in the second orientation and supporting item 412 (e.g., a creased paper). As shown, the device 400 may advantageously support, for example, a creased paper which may hold a sample and enable a user to move the device 400 without disturbing the sample when the device is in the second orientation.

Figure 4E:
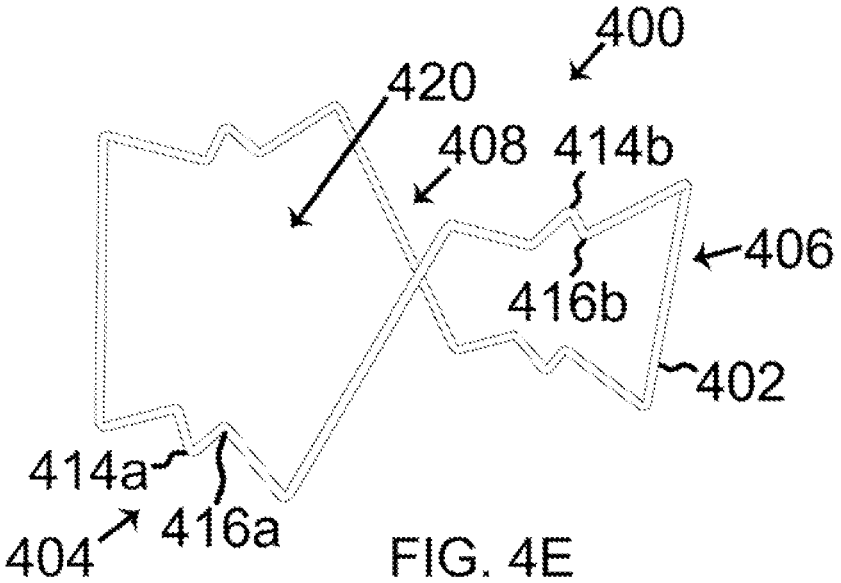
FIG. 4E illustrates an isometric view of an alternative version of the fourth embodiment.

FIG. 4E illustrates an isometric view of an alternative version of the device 400, wherein the first support 404 and the second support 406 each have at least one trough 414*a*, 414*b* and at least one crest 416*a*, 414*b*.

Figure 4F:
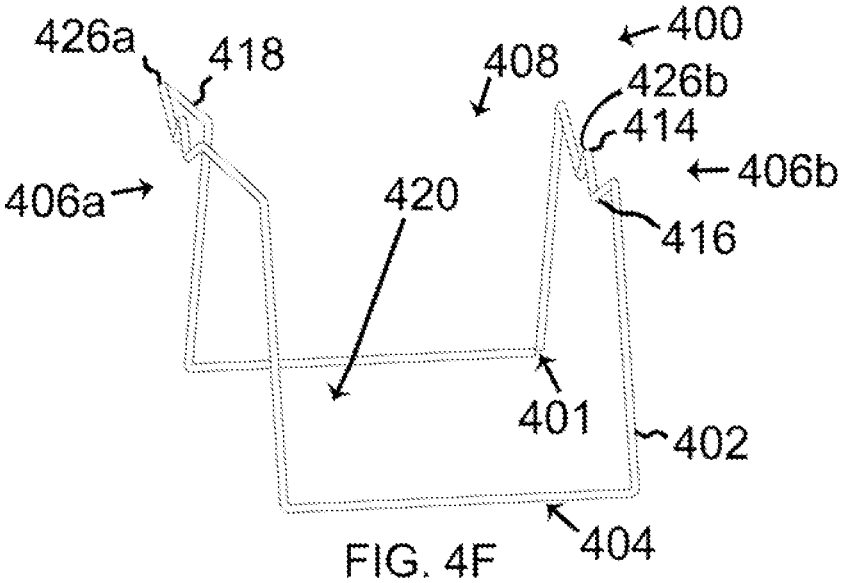
FIG. 4F illustrates an isometric view of another alternative version of the fourth embodiment.

FIG. 4F illustrates an isometric view of another alternative version of the device 400. The device 400 includes a pair of second supports 406*a*, 406*b*, wherein the second support 406*a* includes a wing 418 and the second support 406*b* includes at least one trough 414 and at least one crest 416. The wing 418 may include a first support surface 426*a* and the trough 414 may include a second support surface 426*b*. Each of the first support surface 426*a* and the second support surface 426*b* may be disposed on a second plane that may be configured to contact a surface when the device 400 is in the second orientation. As further illustrated by FIG. 4F, the device 400 may have a gap 401, though any embodiment of the device 400 may include a gap 401 of any size.

It is foreseen, though not illustrated, that the first support and/or the second support may not have any crests and/or wings. In some examples, the first support and/or the second support may be flat, undulating, wavy, or any other shape or pattern. It is also foreseen that the first support and/or the second support may have one or more crests and one or more troughs or a wing.

Figure 5A:
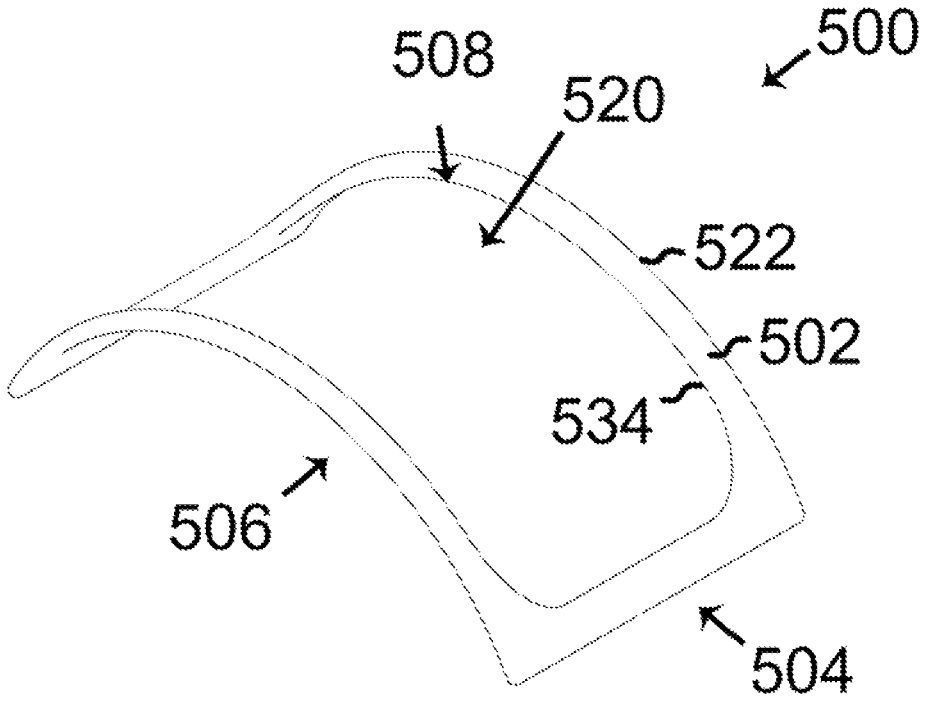
FIG. 5A illustrates an isometric view of a fifth non-limiting embodiment of the laboratory device.

FIG. 5A illustrates an isometric view of a fifth non-limiting embodiment of the laboratory device 500. The device 500 includes a body 502 extending about and defining an opening 520. The device 500 may be manufactured from a solid or rigid material (i.e., metal, plastic, rubber, etc.), from a malleable or resilient material (i.e., silicone, thin metal, wire, etc.), or a combination of materials. The body 502 includes a first support 504 configured to contact a surface when the device 500 is in a first orientation of a plurality of orientations. The body 502 also includes a second support 506 configured to contact a surface when the device 500 is in a second orientation, where the second orientation is inverted from the first orientation.

The body 502 includes an outer perimeter 522 having a generally rectangular shape, though the outer perimeter 522 may have any shape such as, but not limited to, a square, polygon, polygon-like, circle, oval, ellipsoid, or the like. The outer perimeter 522 may have sharp, angled, or rounded corners. The body 502 also includes an inner perimeter 534 defined by the opening 520. The inner perimeter 534 generally includes a rectangular shape with rounded corners, though the inner perimeter 534 may have any shape such as, but not limited to, a square, polygon, polygon-like, circle, oval, ellipsoid, or the like. Further, the inner perimeter 534 may have sharp or angled corners.

The body 502 may also define a cradle 508 operable to receive and hold at least one item 512 (shown in FIG. 5B) when the body 500 is arranged in a first position or a customized position of a plurality of positions. The first position may be a position of the device 500 after manufacturing (e.g., as sold). In other words, the device may start with a wide opening as originally formed but the user may squeeze the sides together to achieve a grip on what they are holding.

Figure 5B:
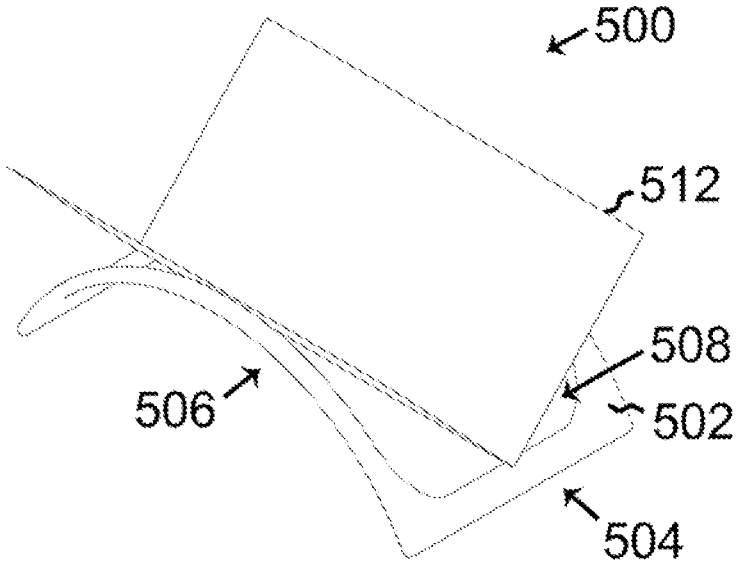
FIG. 5B illustrates an isometric view of the fifth embodiment supporting an item.

FIG. 5B illustrates an isometric view of the device 500 supporting item 512 (e.g., a creased paper). As shown, the cradle 508 may be arranged to hold the item 512 in a first orientation, as shown in FIG. 5B, and may be arranged to hold an item 512 in a second orientation, not shown. The cradle 508 may be arranged in any number of positions when the device 500 is in any number of orientations.

Figure 5C:
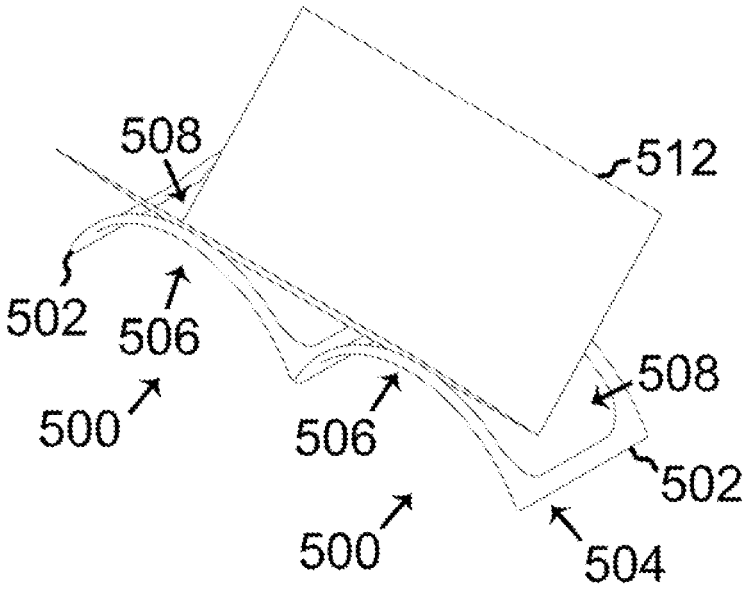
FIG. 5C illustrates an isometric view of a pair of the fifth embodiment devices supporting an item.

FIG. 5C illustrates an isometric view of a pair of the devices 500 supporting item 512 (e.g., a creased paper). Each cradle 508 of the pair of devices 500 may support the item 512. As shown, more than one device 500 may be used together to support items of various sizes.

A system of devices as described in any of the previous embodiments may include one, two, or more than two devices. Multiple devices may support items of various sizes and/or shapes. Further, two or more devices may be stacked to save space or they may be stacked to increase strength. The devices may further be capable of being recycled, autoclaved, and/or sterilized.

The devices as described in the present disclosure advantageously provide support to at least one item that may be various sizes. The devices may be resilient and malleable to different orientations and/or positions to beneficially provide support for any item on any surface. The devices are further lightweight, reusable, strong, and cost-effective to produce and purchase. As such, the devices provide support for items of varying sizes and shapes in a multitude of settings and industries.

While the present disclosure has been described with reference to various implementations, it will be understood that these implementations are illustrative and that the scope of the disclosure is not limited to them. Many variations, modifications, additions, and improvements are possible. More generally, implementations in accordance with the present disclosure have been described in the context of particular implementations. Functionality may be separated or combined in blocks differently in various implementations of the disclosure or described with different terminology. These and other variations, modifications, additions, and improvements may fall within the scope of the disclosure as defined in the claims that follow.

What is claimed is:

1. A laboratory device comprising:

a body extending about and defining an opening;

a first support defined by the body, the first support configured to contact a surface when the device is in a first orientation;

at least one trough forming the first support, the at least one trough contacting the surface when the device is in the first orientation;

a second support defined by the body, the second support coupled to the first support, the second support configured to contact the surface when the device is in a second orientation, the second orientation being inverted from the first orientation;

at least one wing forming the second support, the at least one wing having a support surface contacting the surface when the device is in the second orientation; and wherein at least one of the first support or the second support is malleable, wherein the body has a uniform thickness between 0.002 and 0.008 inches, and wherein a material of the device has a modulus of elasticity between 60 and 80 Giga Pascals and a specific modulus between 20 and 30 E/p.

2. The device of claim 1, wherein when the body is flattened, an outer perimeter of the body is rectangular shaped with rounded corners.

3. The device of claim 1, wherein an inner perimeter defined by the opening includes a pair of elongated edges that are parallel to each other, a cut-out feature having one or more semi-circular divots, and at least one transitional section extending between the pair of elongated edges and the cut-out feature.

4. The device of claim 1, further comprising at least one crest adjacent to the at least one trough.

5. The device of claim 1, wherein the body has a first surface and a second surface, wherein the first surface contacts the surface when the device is in one orientation of a set of orientations, and wherein the second surface contacts the surface when the device is in another orientation of the set of orientations.

6. The device of claim 1, further comprising a cradle defined by the body, the cradle configured to receive and hold at least one item with the body arranged in a first position selected from a plurality of positions.

7. The device of claim 6, wherein the cradle is configured to receive and hold the at least one item with the body arranged in a first customized position selected from the plurality of positions.

8. The device of claim 7, wherein a first wing of the at least one wing is spaced a first distance from a second wing of the at least one wing when the cradle is in the first customized position and the first wing is spaced a second distance from the second wing when the cradle is in a second customized position.

9. A laboratory device comprising:

a body extending about and defining an opening;

a first support defined by the body, the first support defining a first plane configured to contact a surface in a first orientation of a plurality of orientations;

a first trough disposed opposite a second trough, each of the first trough and the second trough disposed on the first plane;

at least one crest disposed adjacent to at least one of the first trough or the second trough;

a second support defined by the body, the second support coupled to the first support, the second support defining a second plane configured to contact the surface in a second orientation of the plurality of orientations;

a first wing disposed opposite a second wing;

a first support surface defined by the first wing; and a second support surface defined by the second wing, the first support surface and the second support surface each being disposed on the second plane;

wherein at least one of the first support or the second support is malleable;

wherein the body has a uniform thickness between 0.002 and 0.008 inches, and wherein a material of the device has a modulus of elasticity between 60 and 80 Giga Pascals and a specific modulus between 20 and 30 E/p.

10. The device of claim 9, further comprising a cradle defined by the body, the cradle configured to receive and hold at least one item with the body arranged in a first position selected from a plurality of positions.

11. The device of claim 10, wherein the cradle is configured to receive and hold the at least one item with the body arranged in a customized position selected from the plurality of positions.

12. A device for supporting an item, the device comprising:

a body, at least a portion of the body being malleable into a first customized position;

a cradle defined by the body, the cradle configured to receive and hold at least one item with the body arranged in the first customized position selected from a plurality of positions and a customized orientation selected from a plurality of orientations;

a first support defined by the body, the first support having a first plane, the first plane contacting a surface when the body is in a first orientation; and a second support coupled to the first support, the second support having a second plane contacting the surface when the body is in a second orientation, the second orientation being inverted from the first orientation, and an opening in the body, and an inner perimeter defined by the opening, the inner perimeter including a pair of elongated edges that are parallel to each other, and at least one transitional section extending between the pair of elongated edges;

wherein the body has a uniform thickness between 0.002 and 0.008 inches, and wherein a material of the device has a modulus of elasticity between 60 and 80 Giga Pascals and a specific modulus between 20 and 30 E/p.

13. The device of claim 12, wherein the cradle is malleable from the first customized position to a second customized position, wherein the cradle is pinched in the first customized position, and the cradle is un-pinched in the second customized position.

14. The device of claim 12, wherein the second support includes at least one wing.

15. The device of claim 12, wherein the first wing is spaced a first distance from the second wing when the cradle is in the first customized position and the first wing is spaced a second distance from the second wing when the cradle is in a second customized position.

16. The device of claim 12, further comprising a cut-out feature having one or more semi-circular divots, wherein the at least one transitional section extends between the pair of elongated edges and the cut-out feature.

17. The device of claim 12, wherein at least one portion of the device comprises a textured surface.

* * * * *